US006419030B1

(12) United States Patent
Turner

(10) Patent No.: US 6,419,030 B1
(45) Date of Patent: Jul. 16, 2002

(54) REVERSIBLE ROAD SCRAPER

(75) Inventor: William H. Turner, Melfa, VA (US)

(73) Assignee: Wood Tech, LLC, Melfa, VA (US)

( * ) Notice: Subject to any disclaimer, the term of this patent is extended or adjusted under 35 U.S.C. 154(b) by 0 days.

(21) Appl. No.: 09/750,780

(22) Filed: Jan. 2, 2001

(51) Int. Cl.[7] ..... A01B 31/00
(52) U.S. Cl. ..... 172/684.5; 172/611
(58) Field of Search ..... 172/684.5, 810, 172/799.5, 781, 780, 817, 611, 189, 197, 777

(56) References Cited

U.S. PATENT DOCUMENTS

| | | | | |
|---|---|---|---|---|
| 92,233 | A | * | 7/1869 | Turner |
| 187,687 | A | * | 2/1877 | Welsh |
| 779,513 | A | * | 1/1905 | Williams |
| 1,082,552 | A | * | 12/1913 | Pinet |
| 1,102,671 | A | * | 7/1914 | King |
| 1,108,126 | A | * | 8/1914 | Boyd |
| 1,143,032 | A | * | 6/1915 | Bresee |
| 1,331,382 | A | | 2/1920 | Rolland |
| 1,428,880 | A | * | 9/1922 | Mott |
| 1,484,497 | A | * | 2/1924 | Hicks |
| 1,663,965 | A | * | 3/1928 | Aikeke |
| 1,667,173 | A | * | 4/1928 | Stewart |
| 1,739,022 | A | * | 12/1929 | Wallick |
| 1,962,990 | A | * | 6/1934 | Katzenberger |
| 2,817,203 | A | * | 12/1957 | Sievers et al. |
| 2,971,588 | A | * | 2/1961 | Schwab |
| 3,052,998 | A | | 9/1962 | Childers ..... 37/150 |
| 3,172,480 | A | | 3/1965 | Bemis ..... 172/7 |
| 3,608,643 | A | | 9/1971 | Flood ..... 172/200 |
| 3,684,031 | A | | 8/1972 | Reynolds ..... 172/686 |
| 4,047,574 | A | | 9/1977 | Foreman ..... 172/178 |
| 4,244,662 | A | | 1/1981 | Olson ..... 404/118 |
| 4,411,323 | A | | 10/1983 | Doss ..... 172/799.5 |
| 4,526,238 | A | | 7/1985 | Williams ..... 172/780 |
| 4,614,240 | A | | 9/1986 | Miller ..... 172/799.5 |
| 4,700,786 | A | | 10/1987 | Berry ..... 172/799.5 |
| 4,802,293 | A | | 2/1989 | Smith ..... 37/108 R |
| 4,898,247 | A | | 2/1990 | Springfield ..... 172/799.5 |
| 5,330,287 | A | | 7/1994 | Constantin ..... 404/90 |
| 5,407,014 | A | | 4/1995 | Tranmer ..... 172/197 |
| 5,511,625 | A | * | 4/1996 | Mork |
| 5,769,171 | A | | 6/1998 | Newman, IV ..... 172/200 |
| 5,795,096 | A | | 8/1998 | Culver ..... 404/90 |

* cited by examiner

*Primary Examiner*—Victor Batson
(74) *Attorney, Agent, or Firm*—John H. Thomas, P.C.

(57) ABSTRACT

A reversible road scraper has two-edged blades that allow the scraper to be pulled in two different directions. The blades can be mounted on springs so that the scraper will not hang up on any objects that could potentially damage the scraper. Also, the scraper may include an edger blade to trim and define the edge of a road.

16 Claims, 4 Drawing Sheets

REVERSIBLE ROAD SCRAPER

The present invention relates to road scraping devices and specifically to a reversible apparatus that has variable features that allow it to be customized to level or grade different types and conditions of roads.

BACKGROUND OF THE INVENTION

A common problem in rural or undeveloped areas is to have uneven dirt and gravel roads. The roads may be rutted or have pot holes. Portions of a road may be washed out by various weather conditions. There may be natural ground shifts that cause unevenness, for instance, the freeze/thaw conditions that are prevalent in many areas. Also, soft roads may become "corrugated" or rippled over time.

There are several solutions to the foregoing uneven road problems. The most thorough solution is simply to pave the roadway. This alternative is expensive and time consuming. Significant road preparation is required. Another solution is the constant addition or replenishment of new gravel and dirt onto a road. Again, this is potentially very expensive and typically requires reasonably heavy equipment.

The most common solution to the uneven road problem is to mount a blade on a vehicle or to drag a blade behind a vehicle to scrape the dirt and/or gravel to make a road level. These blades may be a single blade or multiple blades. They are usually preset with respect to their angle of scraping the ground. These blades are unidirectional in that they are operable in a single direction and must be pulled or mounted in only one way. This unidirectional aspect means a conventional scraper must be turned around at a dead end of a road, which can be a difficult task on a narrow road.

Many known blade assemblies are not variable. The blade angle and the blade width are conventionally preset. Also, the weight of a dragged device is typically predetermined. These prior art assemblies are usually very stiff, so they can hang up on roots or large stones, thereby causing potential damage to an assembly. The traditional blades also typically have a specialized hitch assembly, for instance, to a tractor. Each of the foregoing limitations makes the leveling or crowning of a driveway or any unpaved road a difficult task.

SUMMARY OF THE INVENTION

Accordingly, it is an object of the present invention to overcome the foregoing drawbacks and provide a reversible road scraper. The present device may be pulled by virtually any vehicle from either end of the assembly. Also, the weight, width and blade angle of the assembly may be varied to allow a user to customize the assembly for a particular road condition. Other improvements include the use of springs to allow the blades that scrape the road to move or recoil in the vertical direction so that they do not hang up on roots or rocks or other objects that could damage the scraper assembly. The assembly may also include an edger blade to keep the side of a road well defined and clear from, for instance, encroaching weeds and plants.

In a preferred embodiment, the reversible road scraper comprises a central beam, a first side beam, and a plurality of blades. The central beam comprises a first end and a second end with a connector at each end. The first side beam is disposed on one side of the central beam and is substantially parallel thereto. The plurality of blades each comprise two ends. The blades are hingedly attached at each end to the central and first side beams. Each blade comprises two edges—one edge angled generally towards the first end of the central beam and the other edge angled generally towards the second end of the central beam. A variable adjuster is connected to the central beam and to the plurality of blades. The road scraper may further comprise a second side beam disposed on the other side of the central beam from the first side beam. The second side beam is substantially parallel to the central beam. A plurality of blades, each comprising two ends, are hingedly attached at each end to the central and second side beams. Each blade comprises two edges—one edge angled generally towards the first end of the central beam, and other edge angled generally towards the second end of the central beam. The scraper may further comprise springs that are adapted to connect each end of each blade to the central and side beam respectively. Also, one end of the side beam may comprise an edger blade. Still further, the scraper may further comprise a variable ballast.

In a further embodiment, a reversible road scraper comprises a frame and a plurality of blades. The frame comprises a first end and a second end and further comprises two beams. Each end of the frame comprises a connector. The plurality of blades each comprise two ends, the blades attached at each end to the two beams. Each blade comprises two edges—one edge angled generally towards the first end of the frame and the other edge angled generally towards the second end of the frame. The blades may be fixedly attached to the two beams. The blades may be oriented substantially perpendicular to the beams. The two beams may be substantially parallel to each other. One of the beams may comprise an edger blade. The frame may further comprise a variable ballast.

In still a further embodiment, a reversible road scraper comprises a beam comprising first and second ends. A connector is included at each end of the beam. The scraper further includes a plurality of blades comprising two ends, the blades attached at one end to the beam. Each blade comprises two edges, one edge angled generally toward the first end of the beam and the other edge angled generally towards the second end of the beam. The blades may be fixedly attached to the beam. There may be a blade attached to each side of the beam. Further, a variable ballast may be mounted on the beam.

DETAILED DESCRIPTION OF THE PREFERRED EMBODIMENTS

Figure 1:
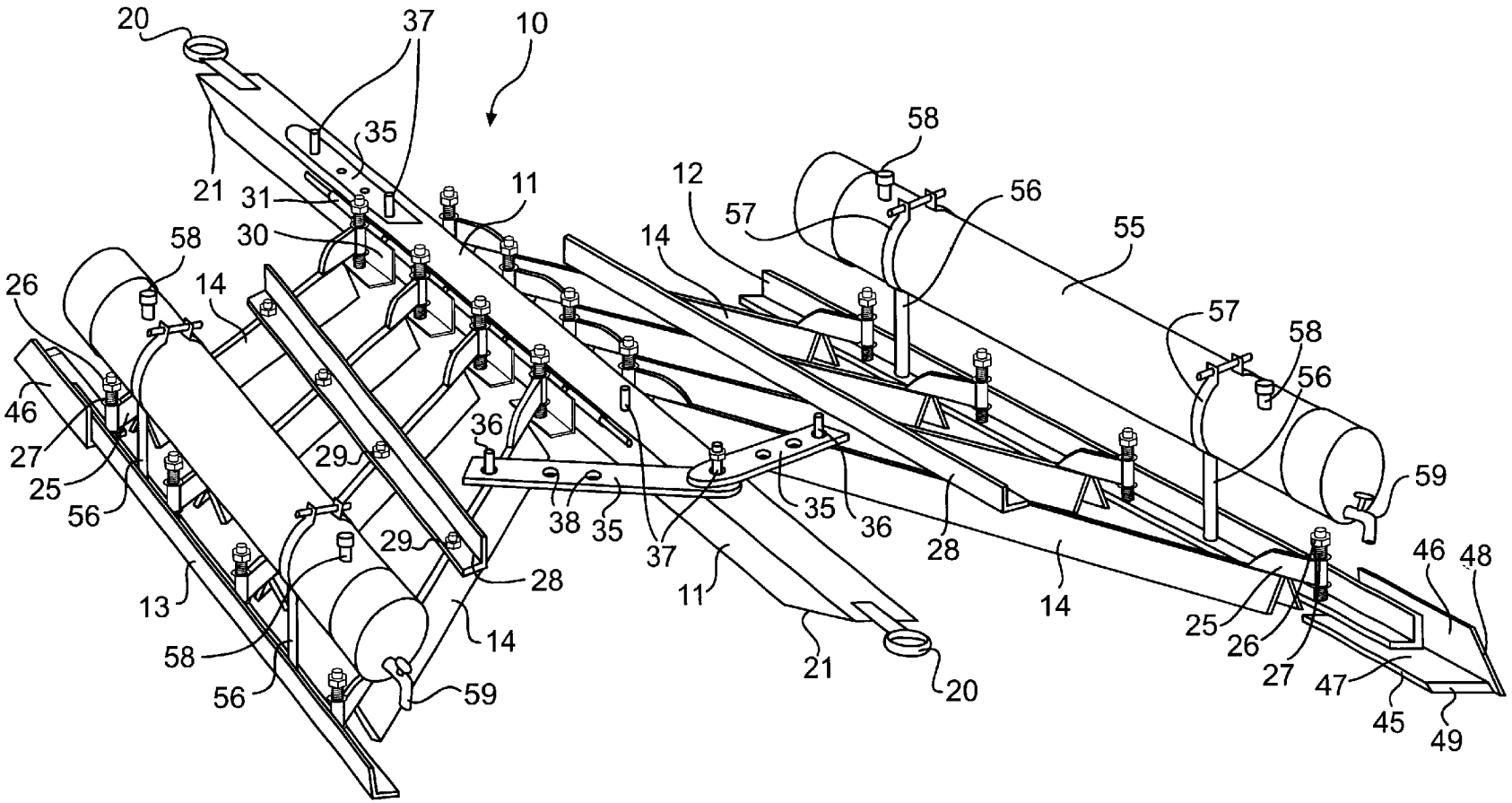
FIG. 1 is a perspective view of a preferred embodiment of the road scraper.
Figure 2A:
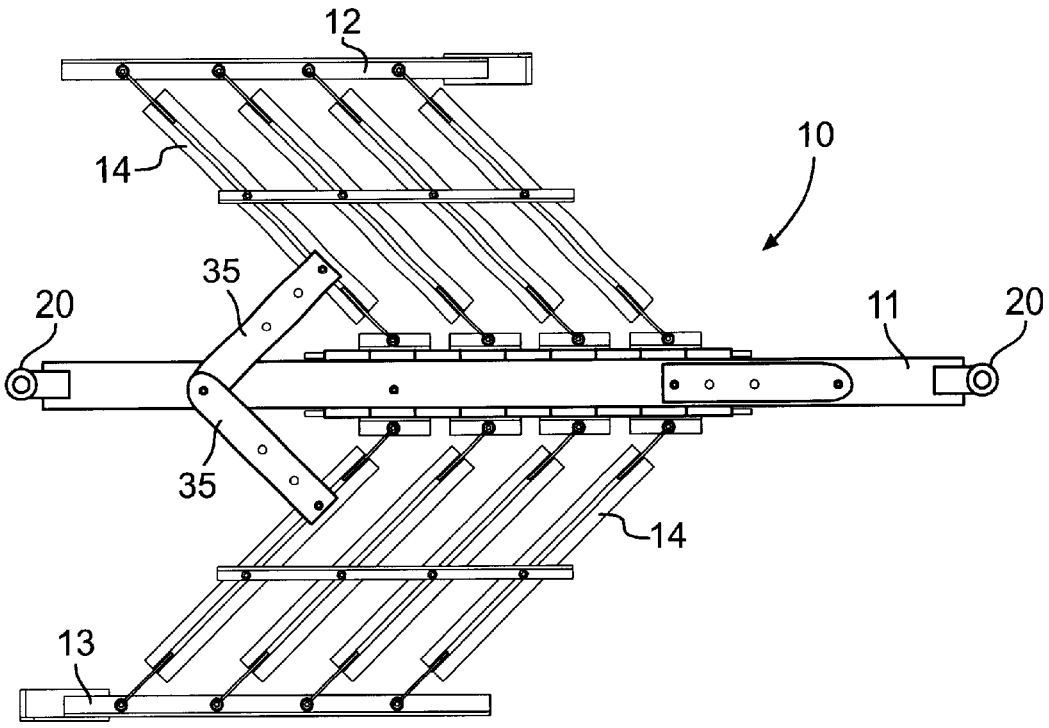
FIGS. 2A–2D are top elevation views of a preferred embodiment of the road scraper in several different variable positions.
Figure 2B:
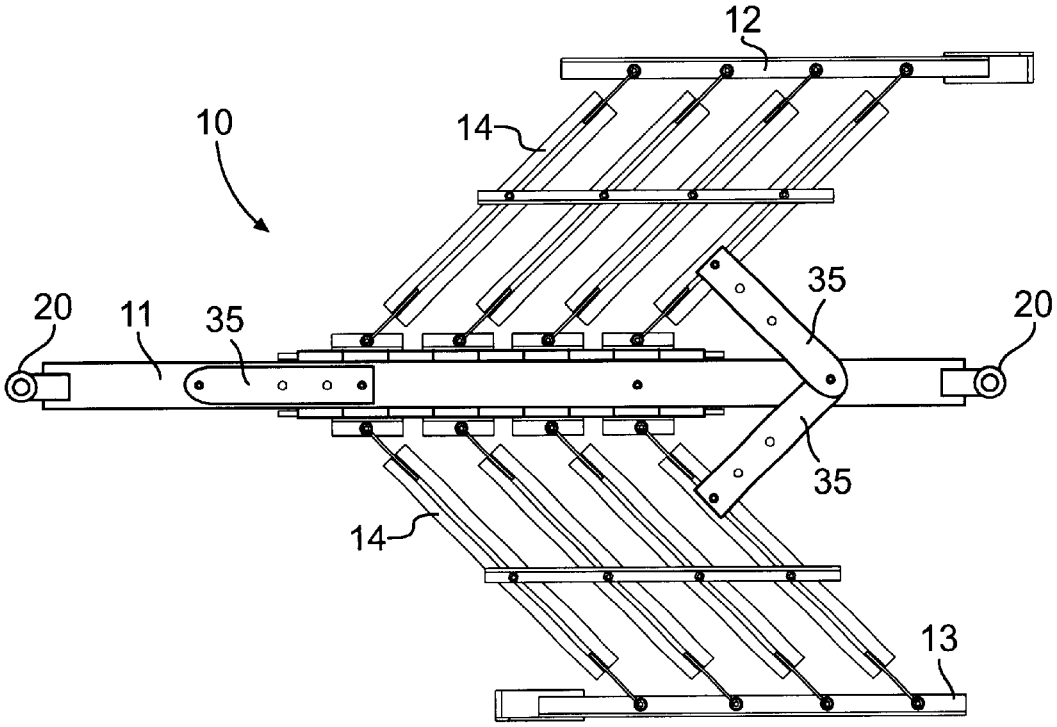
Figure 2C:
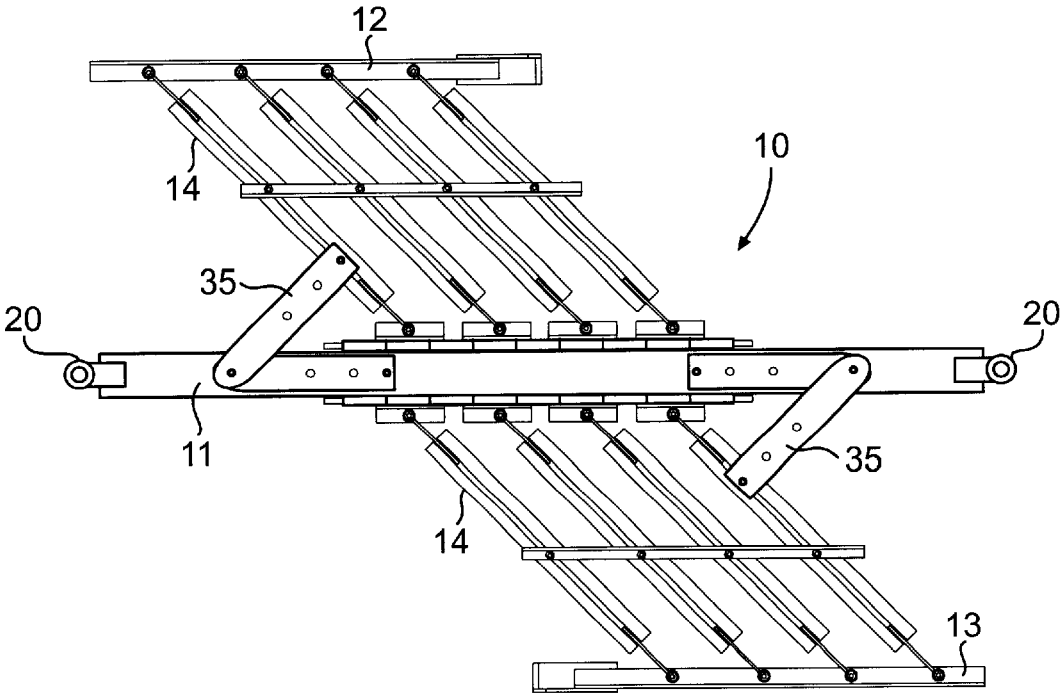
Figure 2D:
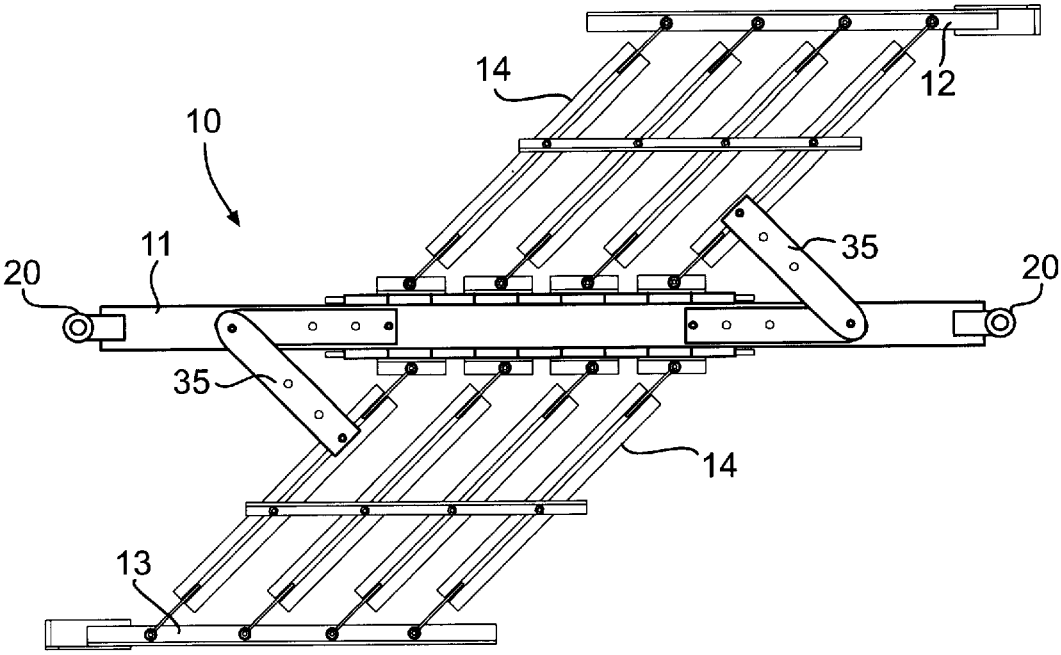
Figure 3:
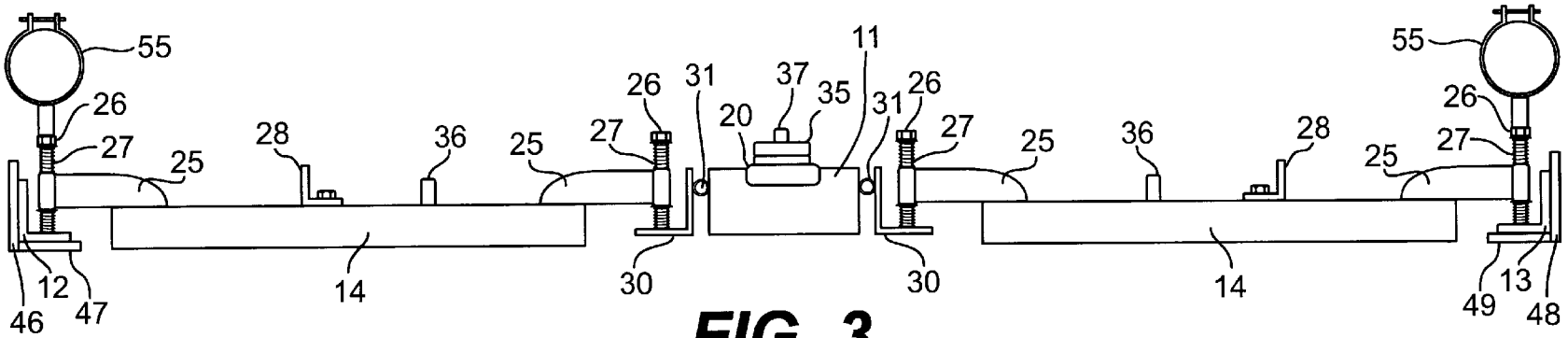
FIG. 3 is a front elevation view of a preferred embodiment of the road scraper.

FIGS. 1 through 3 illustrate various views of a preferred embodiment of a road scraper in accordance with the present invention. The scraper 10 is intended to be dragged behind a tractor, truck or any other vehicle along a soft road. The road may be a dirt road or sand road or gravel road or any combination of the foregoing. The scraper 10 may even be dragged behind a vehicle in order to scrape snow or ice off of a paved road. The scraper 10 is attached to the vehicle by means of a hitch or chain or rope or any other method that allows the scraper to be pulled behind the vehicle. There is no specific type of hitch or hitch assembly that is required.

The scraper 10 is made of a central beam 11 and two side beams 12 and 13. Blades 14 are connected at each end to the central beam 11 and side beams 12 or 13 respectively. The central beam 11 is made of a hollow steel beam approximately four inches by four inches. The beam 11 is fourteen feet long. The beam 11 can be made of any suitable material that is durable enough to be dragged over dirt and gravel roads and be an anchor for the blades 14. Connectors 20 are welded onto each end of the central beam 11. Connectors 20 have holes in them through which a chain or cable or other device can be used to connect the central beam to a vehicle. The connector 20 can be a hitch assembly or even just a post that allows the scraper to be chained or tied behind a vehicle. The side beams 12 and 13 are angle iron pieces having approximately two inch legs. The side beams are structural support onto which is mounted one end of each of the blades 14.

The blades 14 are angle iron sections wherein the two legs of the angle iron are pointed downwardly and rest on the ground when the scraper 10 is on the ground, thereby forming edges that angle generally towards one end or the other end of the central beam 11. The blades 14 are evenly spaced apart to enable the variable angle of the blades with respect to the central beam 11. The blades 14 further include two flat, metal hinge connectors 25 that are adapted to connect to hinges pins 26—one of which is connected on one end to the central beam 11 and the other of which is connected on the other end to the side beams 12 and 13. The connection of the hinge 25 to the side beams 12 and 13 is by way of the hinge pin 26. The assembly further includes a spring 27. The spring 27 may be tightened or loosened to bias more or less pressure downward for each blade 14. In other words, if the ground is soft, then the blades may be loosely mounted in the scraper 10. However, if the ground is very rigid, then the blades 14 may be tightened by way of the springs 27 so that the blades will press firmly against the ground over which the scraper 10 is drug. The connection between the central beam 11 and the blades 14 is further modified by a second hinge 30 and hinge pin 31 that allow the side beams 12 and 13/blades 14 assemblies to flap upwardly. This inside hinge assembly 30 and 31 is best seen in FIG. 3. The hinge assembly 30 and 31 in combination with the springs 27 allows the scraper 10 to be adjusted so that it may press firmly against a ground or, alternatively, may recoil and bounce so that the scraper 10 does not hang up on any roots or stones that could bend and permanently damage the scraper. The blades 14 are further reinforced by stabilizer bars 28 which are hingedly connected to each set of blades on each side of the scraper 10.

Four blades 14 are shown mounted on each side of the central beam 11. Any number of blades 14 may be suitable depending on the scraping job to be done. Even an asymmetric assembly of blades 14 may be used (for instance five blades on one side and four blades on the other), although a symmetric assembly as shown is preferable.

Also, the blades 14 are all shown having straight edges on the ground. It may be preferable to have a teethed edge (not shown) or other configuration to better cut the dirt and gravel while other straight edges smooth the surface.

The angle of the blades 14 with respect to the central beam 11 can be varied by using the adjuster 35. The adjuster 35 is a flat piece of steel that is rotatably connected around a post 37 fixed on the central beam and a post 36 that is fixed on a blade 14. The post 36 that sets the pitch of the blades may alternatively be fixed in the stabilizer bar 28 or, possibly, even the side beams 12 and 13. The adjuster 35 has apertures 38 so that the adjuster can change the pitch of the angle of the blades 14 by changing the apertures that are used to mount around the posts 36 and 37. The posts 37 and 36 may further include caps or other removable nuts to keep the adjuster 35 in place and so that the adjuster does not pop off of a post during use.

Examples of how blade pitch may be adjusted with respect to the central beam 11 are illustrated in FIGS. 2A through 2D. As can be seen, the blades 14 may be aligned in a generally straight line all the way across the scraper 10 so that dirt/gravel may be guided to one side of the scraper (FIG. 2C). Alternatively, the blades 14 may be pitched in exactly the opposite direction to guide dirt and gravel in the opposite direction (FIG. 2D). FIGS. 2A and 2B illustrate how the dirt and grave may be directed to the center (FIG. 2A) or sides (FIG. 2B) of a road. As is evident from the drawings, different pitches and different angles may be used in addition to those shown in FIGS. 2A through 2D. The pitch may be adjusted to best meet the needs of a given road in a given condition. For instance, if a road merely needs to be smoothed out, then the blades 14 may be set in an exactly perpendicular position to the central beam 11. Also, the pitch of blades 14 on either side of the central beam 11 may be different.

The side beams 12 and 13 also have edger blades 45. The edger blades 45 are attached to the front left (when in pulling position) orientation of the scraper 10. The edger 45 includes vertical 46 and horizontal 47 components as well as the angled points 48 and 49 that make up the front edge of the vertical and horizontal components. This edger 45 is preferably oriented in this particular corner of the scraper 10 because it would be visible to a person driving a car or truck that is dragging a road scraper 10. The edger 45 may just as easily be mounted on the other side or both sides of the scraper 10.

FIG. 3 also illustrates ballast tanks 55 that may be mounted onto the scraper 10. The ballast tanks 55 are added so that additional weight may be applied to the scraper 10 as a whole or to each side in the event the road surface is very hard. The ballast tanks 55 may be mounted anywhere on either side of the central beam 11. They may also be mounted on the central beam 11. As shown in FIG. 3, the ballast tanks 55 are mounted onto posts 56 on the side beams 12 and 13 and are held there by brackets 57. Preferably, the ballast tanks 55 are empty tanks that may be filled or emptied of fluid so that the scraper 10 may be lightened or made heavy in accordance with the specific requirements of a given road condition. The ballast tanks 55 have resealable inlets 58 that allow the tanks to be filled and vented during filling or draining. There is also a drain spigot 59 to allow the ballast 55 to be emptied.

Several alternatives are available to a user when incorporating a ballast system like the ballast tanks 55 shown. A user may fill the tanks 55 with an herbicide and connect nozzles (not shown) to the drain spigot 59. As the scraper 10 is dragged down a road, a herbicide can be sprayed from the scraper along the middle or sides of a road, or both. Still further, if a gravity feed does not provide an adequate spray, then a pump can be mounted on the ballast tank 55 or central beam 11.

Also, a pump and hose connection could allow fluid (weight) to be transferred from one tank 55 to another. The pump can be run off of the vehicle battery or a separate battery or motor.

Figure 4A:
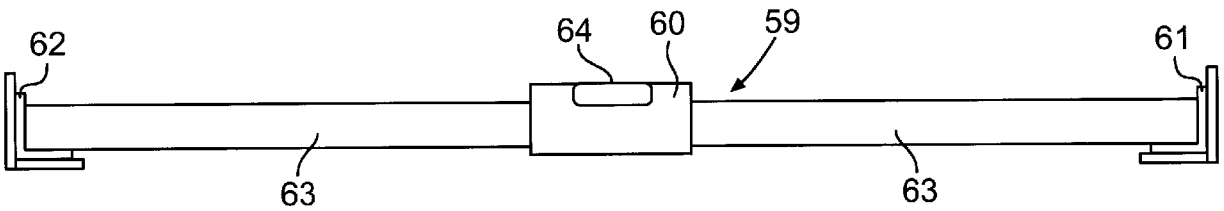
FIGS. 4A and 4B are front elevation views of alternative embodiments of the present invention.
Figure 4B:
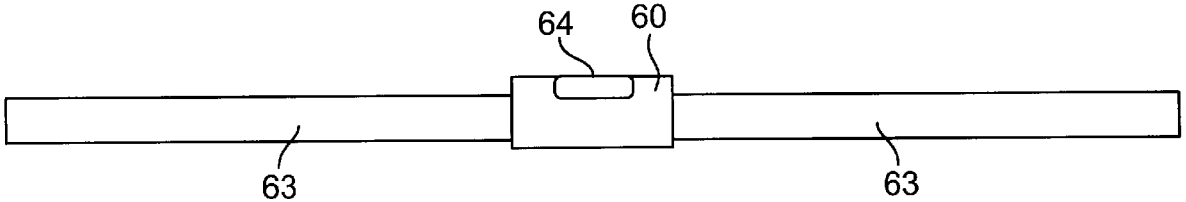

FIG. 4A illustrates an alternative embodiment of the present invention. The scraper 59 is made up of a central beam 60 and two side beams 61 and 62. Blades 63 are welded at each end to the central beam 60 and side beams 61 and 62 to collectively form a rigid frame. The entire frame, therefore is then able to be attached via a connector such as a post or loop such as post 64 to a vehicle to be dragged behind and scrape a road. The blades 63 may be welded in a perpendicular relationship with respect to the central beam 60. Alternatively, the blades 63 may be welded at predetermined angles with respect to the central beam 60. In this fixed frame embodiment, the side beams 61 and 62 are shown to be parallel to the central beam 60. In this case, however, the side beams 61 and 62 may be angled in an acute or obtuse relationship with respect to the central beams 60, because the entire frame is fixed as a single unit. (This variability is as opposed to the embodiments shown in FIGS. 1–3 where the side beams 12 and 13 need to be substantially parallel to the central beam 11 to allow the blades to be rotated forward and back with respect to the central beam.) FIG. 4B illustrates a still further embodiment where blades 63 are welded to central beam 60, and there are no side beams. Like the embodiment in FIG. 4A, the blades 63 may be attached at parallel or varied angles to the central beam 60.

The blades 14 are shown throughout to be simple angle irons turned upside down so that there are two edges—each facing downwardly and one angled generally toward each end of the central beam 11. The actual shape of the blades of the present invention may be varied in accordance with the preferences of a scraper designer. For the purposes of this invention, it is only essential that the blade have two edges, one facing each of the respective ends of the central beam 11. In this way, the scraper 10 may be pulled from either end by a vehicle.

The adjuster 35 is shown as a rigid piece of material having a predetermined holes 38 that set the pitch of the blades 14 with respect to the central beam 11. The adjuster 35 may be a cable that may be wound around a crank, for instance, to allow more flexibility and precision when setting the specific angle or pitch of the blades 14. Other types of adjusters include chains, pneumatic or hydraulic pistons, or any other type of strong material that can be used to set blades at a certain angle.

While the preferred embodiment of the scraper 10 has two side beams 12 and 13, it is possible that only one side beam or more than two side beams can be used. That is, there could be only a central beam and one side beam with the variable angle of the blades there between. The connector to the vehicle could be on the central beam as shown. Alternatively, the connector from the scraper to the vehicle may be through a chain or cable mechanism that attaches both the front of the central beam and the front of the side beam. Still further, the connector can be fixed to the middle of a blade. The pitch of the blades versus the two beams can be varied in accordance with the teachings of the present invention. As noted, a still further alternative would be a rigid attachment to the two beams.

While the invention has been described with reference to specific embodiments thereof, it will be understood that numerous variations, modifications and additional embodiments are possible, and accordingly, all such variations, modifications, and embodiments are to be regarded as being within the spirit and scope of the invention.

What is claimed is:

1. A reversible road scraper comprising:

a central beam comprising a first end and a second end with a connector at each end;

a first side beam disposed on one side of the central beam and substantially parallel thereto;

a plurality of blades each comprising two ends, the blades hingedly attached at each end to the central and first side beams, wherein each blade comprises two edges, one edge angled generally towards the first end of the central beam and the other edge angled generally towards the second end of the central beam; and a variable adjustor connected to the central beam and to the plurality of blades.

2. The reversible road scraper described in claim 1, further comprising:

a second side beam disposed on the other side of the central beam from the first side beam and substantially parallel to the central beam;

a plurality of blades each comprising two ends, the blades hingedly attached at each end to the central and second side beams, wherein each blade comprises two edges, one edge angled generally towards the first end of the central beam and the other edge angled generally towards the second end of the central beam.

3. The reversible road scraper described in claim 2, further comprising springs that are adapted to connect each end of each blade to the central and side beams respectively, thereby enabling limited independent motion of each blade with respect to the beams.

4. The reversible road scraper described in claim 2, wherein one end of each of the side beams comprises an edger blade.

5. The reversible road scraper described in claim 1, further comprising springs that are adapted to connect each end of each blade to the central and side beam respectively, thereby enabling limited independent motion of each blade with respect to the beams.

6. The reversible road scraper described in claim 1, wherein one end of the side beam comprises an edger blade.

7. The reversible road scraper described in claim 1, further comprising a variable ballast.

8. A reversible road scraper comprising a frame comprising a first end and a second end and further comprising two beams;

a connector at each end of the frame; and a plurality of blades comprising two ends, the blades attached at each end to the two beams, wherein each blade comprises two downwardly pointed edges, one edge angled generally towards the first end of the frame and the other edge angled generally towards the second end of the frame.

9. The reversible road scraper described in claim 8, wherein the blades are fixedly attached to the two beams.

10. The reversible road scraper described in claim 8, wherein the two beams are substantially parallel to each other.

11. The reversible road scraper described in claim 8, wherein one of the beams further comprises an edger blade.

12. The reversible road scraper described in claim 8, wherein the frame further comprises a variable ballast.

13. A reversible road scraper comprising:

a beam comprising first and second ends;

a connector at each end of the beam; and a plurality of blades comprising two ends, the blades attached at one end to the beam, wherein each blade comprises two downwardly pointed edges, one edge angled generally towards the first end of the beam and the other edge angled generally towards the second end of the beam.

14. The reversible road scraper described in claim 13, wherein the blades are fixedly attached to the beam.

15. The reversible road scraper described in claim 13, further comprising a blade attached to each side of the beam.

16. The reversible road scraper described in claim 13, further comprising a variable ballast mounted on the beam.

* * * * *